United States Patent [19]

Sailor

[11] 4,330,972

[45] May 25, 1982

[54] DOOR JAMB ASSEMBLY

[75] Inventor: Vernon R. Sailor, Elkhart, Ind.

[73] Assignee: Sailor Manufacturing Inc., Elkhart, Ind.

[21] Appl. No.: 171,731

[22] Filed: Jul. 24, 1980

[51] Int. Cl.[3] ..... E06B 1/04

[52] U.S. Cl. ..... 52/211; 52/213; 49/504

[58] Field of Search ..... 52/211, 213; 49/504

[56] References Cited

U.S. PATENT DOCUMENTS 3,681,876 8/1972 Linder et al. ..... 49/504

4,179,849 12/1979 Kuffver ..... 52/213 X 4,281,480 8/1981 Wendt ..... 52/213 X 4,281,481 8/1981 Wendt ..... 52/211 X

*Primary Examiner*—Carl D. Friedman

*Attorney, Agent, or Firm*—Oltsch, Knoblock & Hall

[57] ABSTRACT

A door frame which is for mounting pre-hung doors in door openings of an existing structure and which includes an extruded metal door frame, a wooden frame for support of the extruded metal frame, fasteners which attach the wooden support frame to the extruded metal door frame and are used for attaching the metal frame at a door opening, and a molded cover which is secured to the extruded metal frame and conceals the fasteners attaching the metal frame to the door opening.

4 Claims, 4 Drawing Figures

DOOR JAMB ASSEMBLY

SUMMARY OF THE INVENTION

This invention relates to a door frame assembly used in fastening pre-hung doors to the door opening of an existing structure.

Heretofore the usual method for mounting a prehung door at a doorway has been to drive fasteners through the side frame of the door assembly and into the door way jamb of the structure. When a door so hung is not properly positioned, the fasteners are removed and the door is reset. This creates mars on the door frame or leaves holes that must be filled or covered to preserve the aesthetic appearance of the door frame. This was necessary because the fastening devices were located in visible portions of the door frame. Since the door frames of the prior art are usually from wood they have to be painted and maintained to keep their appearance. Also, when resetting a door frame made of wood, the wood often has a tendency to split as a result of drying or curing.

The door frame of this application includes an extruded metal outer frame which is formed to accommodate a wooden frame support member which fits into the outer frame. The outer frame is secured to the support member with screws or other means turned or driven into the support frame. The connected wooden support member and metal frame are fitted into the door opening with attachment means such as screws turned through an anchor flange of the metal frame and into door jambs and header sides and top of the door opening. The screws are then covered by a strip decorative member which snaps into place between ridges in the anchor flange of the outer frame.

This construction accommodates the resetting of a door. The resetting can be easily accomplished by removing the decorative member and removing the fastening means driven through the anchor flange of the outer frame. Since the fastening means are covered by the decorative member when in place, there is no need to be concerned about visibly marring or defacing the frame when resetting the door. This method of attaching the door frame also allows for easy removal of a door if it must be replaced. By making the outer frame of extruded metal and the decorative member of vinyl or other molded material, the door frame is essentially maintenance free.

Another advantage provided by this invention is that the production cost is less than the cost of producing an all-wood door frame. Also, the metal-wood combination provides a frost barrier which is conducive to better insulation of the interior of the structure to which the door is attached.

Accordingly, it is an object of this invention to provide a novel door frame for pre-hung doors.

Another object of this invention is to provide a door frame which may be easily removed or adjusted.

It is another object of this invention to provide a door frame which has means hidden from sight for attaching it to the door jambs of a wall.

Still another object of this invention is to provide a door frame which is essentially maintenance free.

Another object of this invention is to provide a door frame which provides a frost barrier as an inherent part of its construction.

Further objects will become obvious upon a reading of the following description.

BRIEF DESCRIPTION OF THE DRAWINGS

A preferred embodiment of this invention has been chosen wherein.

DESCRIPTION OF THE PREFERRED EMBODIMENT

The preferred embodiment illustrated is not intended to be exhaustive nor to limit the invention to the precise form disclosed. It is chosen and described in order to explain the principles of the invention and its application and practical use to thereby enable others skilled in the art to best utilize the invention.

The door frame assembly 8 of this invention includes a three sided outer frame 10, a corresponding wooden inner frame 12 and a decorative or cover member 14. A threshold of conventional design may be used with assembly 8.

Figure 1:
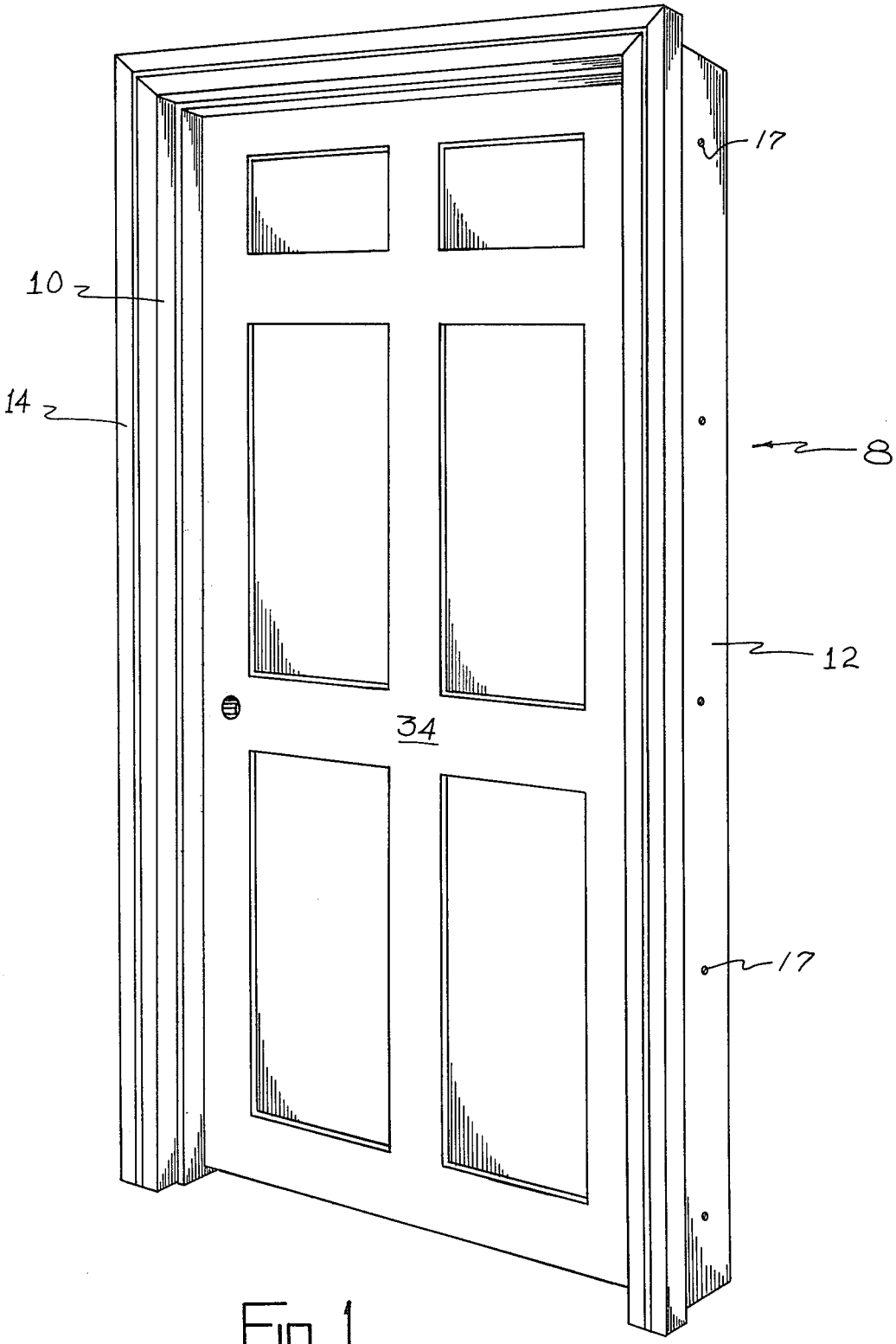
FIG. 1 is a perspective view of the door assembly.
Figure 2:
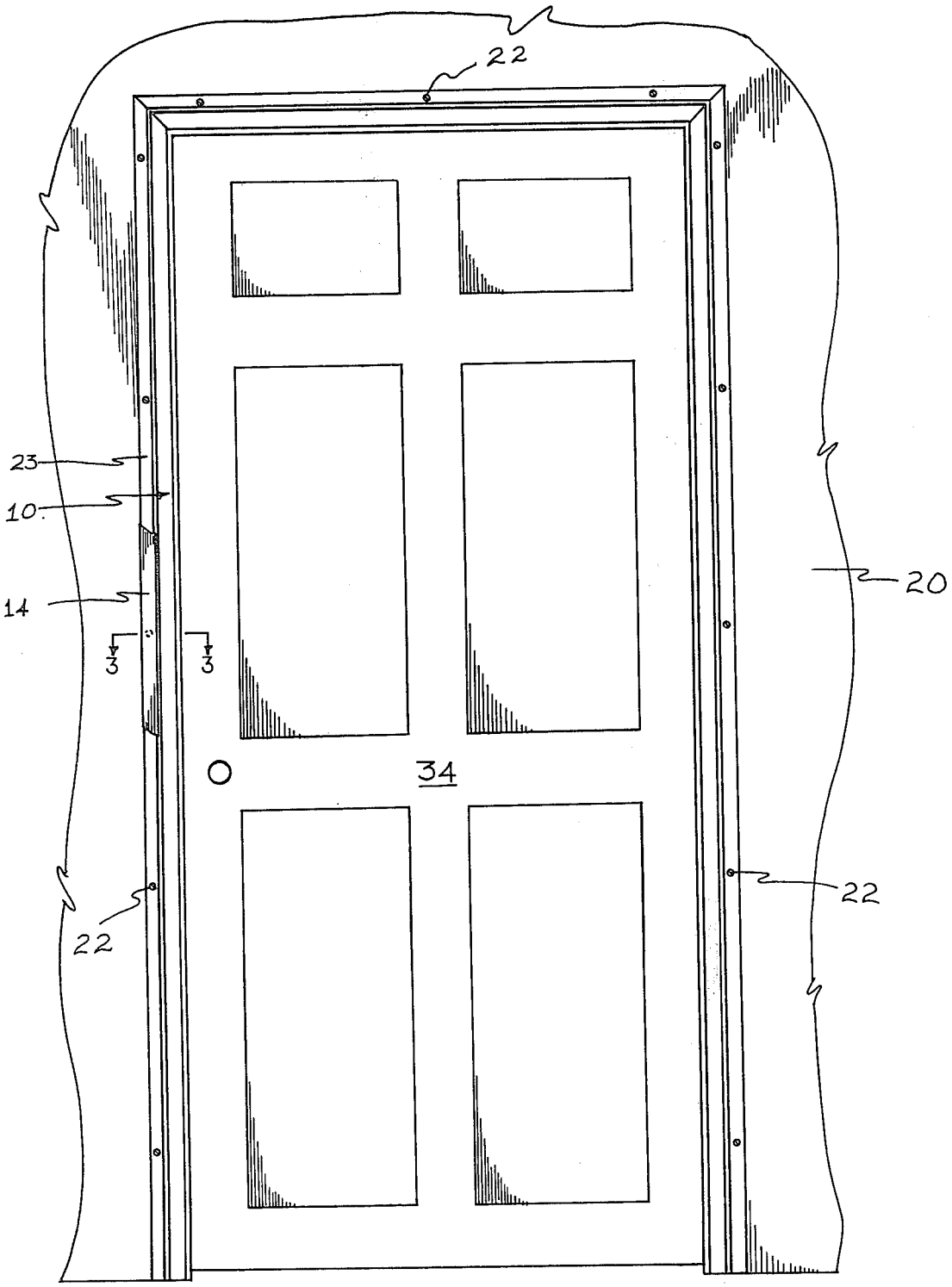
FIG. 2 is a front elevational view of the door assembly with a fragment of a decorative member illustrated therein.
Figure 4:
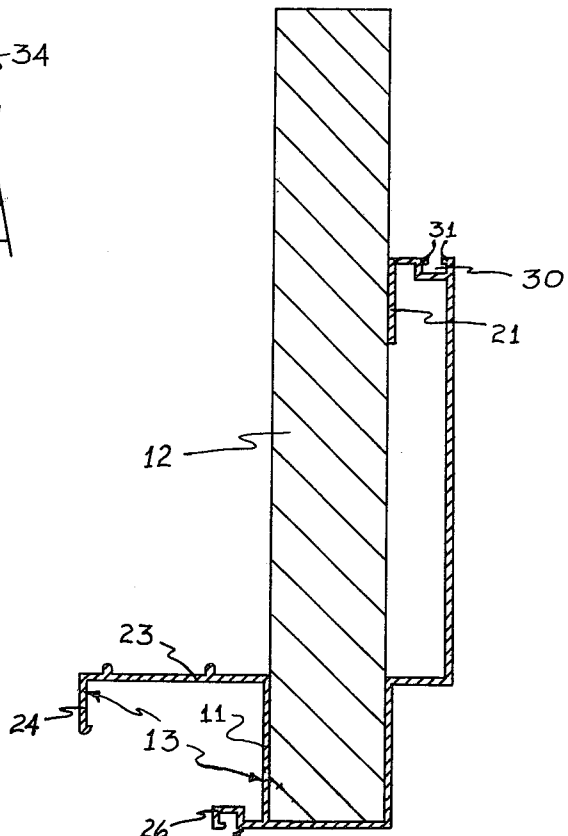
FIG. 4 is a sectional view of the metal door frame and wooden support frame.
Figure 3:
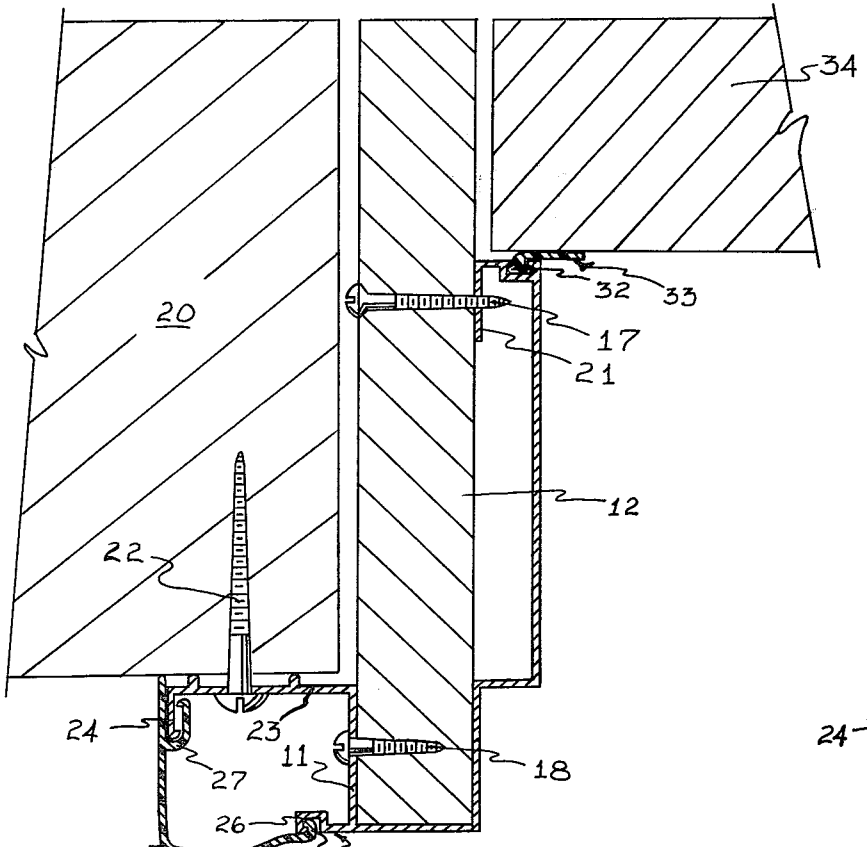
FIG. 3 is a sectional view taken along line 3—3 of FIG. 2.

The outer frame 10 is preferably made of an extruded metal material and is of the uniform cross section as shown in FIGS. 3 and 4. Outer frame 10 is configured to receive the inner frame 12 which fits snugly into it. Inner frame 12 is preferably secured to the outer frame 10 by screws 17 and 18 or other attachment means. Screws 17 are turned through the frame 12 and anchor into inturned return flange 21 of the outer frame 10. Screws 18 are driven through one wall 11 of a U-shaped portion 13 of the outer frame 10 and are anchored in the frame 12. Screws 17 and 18 remain hidden from view when the door frame assembly is in position against the existing wall structure 20 which defines the door opening.

The door frame assembly 8 is secured to the sides and top of the door opening in an existing structure 20 by use of screws 22 or other means turned through an outturned flange or wall 23 of portion 13 of the outer frame 10 and anchored in the existing structure 20. Wall 23 terminates in a longitudinal lip 24 which preferably extends perpendicularly outwardly from the margin thereof. A flange 25 projects substantially perpendicularly from wall 11 and preferably terminates in a groove part 26.

The walls 11 and 23 are covered by the decorative member 14 which is generally L-shaped. Decorative member 14 includes a longitudinal marginal U-shaped part 27 which fits around the lip 24 and an opposite longitudinal marginal hook part 28 which anchors in groove part 26. Decorative member 14 is retained in place by U-shaped margin 27 straddling lip 24 and the snap interlock of hook part 28 with groove 26, covering screws 22 turned into the underlying structure 20. When the door frame assembly is anchored to door opening structure 20 and decorative members 14 are applied, no means of attachment to the opening structure is visible. The frame assembly can be easily adjusted within the existing door opening by the simple removal and replacement of screws 22.

The return bent portion 21 of the outer frame 10 provides a stop for the door 34 and is provided with a U-shaped longitudinal channel 30 whose mouth is defined by inturned ribs 31. Channel 30 receives with a snap fit a molded enlargement 32 of strip 33, preferably formed of rubber or other suitable flexible material, which is engaged by the margin of door 34 and serves as a seal or weather strip.

It is understood that the invention is not to be limited by the preceding description, but may be modified within the scope of the appended claims.

What I claim is:

1. A preconstructed door frame assembly adapted for insertion into a door opening defined by an outlining wall structure, said frame assembly comprising a metal outer frame having a U-shaped part at one margin, said U-shaped part terminating in an outturned wall, a wooden inner frame member, one edge of said inner frame member fitting into said outer frame U-shape part with said outturned wall of the outer frame being located to project outwardly from the inner frame member, first fasteners securing said inner frame member to said outer frame, said frame member outturned wall and inner frame member adapted to overlie spaced portions of said wall structure defining said door opening when said frame assembly is inserted into the door opening, said frame member outturned wall constituting means for receiving second fasteners anchored into said wall structure to secure the frame assembly to the wall structure at said door opening, a cover strip co-extensive with said outer frame, means for connecting said cover strip to said outer frame over said outturned wall of the outer frame to cover said second fasteners when anchored into said wall structure.

2. The door frame assembly of claim 1 wherein said inner frame member extends beyond the opposite margin of said outer frame from said U-shaped part and is adapted to overlie a said portion of the wall structure to form an insulative function.

3. The door frame assembly of claim 1 and a return bent portion formed at the opposite margin of said outer frame from said U-shaped part thereof, said inner frame member contacting said outer frame return bent portion and being secured thereto by said first fasteners, said first fasteners extending through said inner frame member and into said outer frame return bent portion so as to be positionable next to a said portion of the wall structure and under said outer frame, whereby said second fasteners will not be seen when the frame assembly is secured to said wall structure at the door opening.

4. The door frame assembly of claim 3 wherein said outer frame is three sided and includes top and side parts of uniform cross section, said inner frame member being formed into corresponding top and side parts, said outturned wall of said outer frame adapted to extend at the top and side parts of the outer frame over the jambs and header of said wall structure at the door opening when the frame assembly is inserted into the door opening.

* * * * *